US007703843B2

(12) United States Patent
Chen et al.

(10) Patent No.: US 7,703,843 B2
(45) Date of Patent: Apr. 27, 2010

(54) COLLAPSIBLE HIGHCHAIR WITH LOCKING DEVICE

(75) Inventors: Shun-Min Chen, Taipei (TW); Zhi Ren Zhong, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 465 days.

(21) Appl. No.: 11/606,097

(22) Filed: Nov. 30, 2006

(65) Prior Publication Data

US 2007/0290528 A1 Dec. 20, 2007

(30) Foreign Application Priority Data

Jun. 13, 2006 (CN) ..... 2006 2 0116565 U

(51) Int. Cl.
*A47D 1/02* (2006.01)

(52) U.S. Cl. ..... 297/41; 297/56; 297/148; 297/154; 297/256.15

(58) Field of Classification Search ..... 297/30, 297/41, 55, 56, 57, 148, 150, 149, 151, 152, 297/153, 154, 155, 256.15, 423.88; 108/120, 108/118, 151, 155; 403/326, 329, 70, 71, 403/66, 108, 109.1, 109.2, 109.3, 102, 100
See application file for complete search history.

(56) References Cited

U.S. PATENT DOCUMENTS 1,738,339 A * 12/1929 Whiting et al. ..... 297/41
2,902,084 A * 9/1959 Stevens ..... 297/29
2,971,567 A * 2/1961 Kimmel ..... 297/134
3,147,036 A * 9/1964 McRae ..... 297/56
3,649,074 A * 3/1972 McDonald et al. ..... 297/153
3,715,142 A 2/1973 Lay et al.
4,008,918 A * 2/1977 Cooper et al. ..... 297/16.1
4,036,523 A * 7/1977 Nielsen ..... 297/130
4,433,869 A * 2/1984 Payne et al. ..... 297/5
5,346,279 A * 9/1994 Pecorella ..... 297/256.1
6,920,830 B1 * 7/2005 Asbach et al. ..... 108/26
7,331,628 B2 * 2/2008 Lin ..... 297/16.2

FOREIGN PATENT DOCUMENTS

GB 385030 A 12/1932
GB 2260485 A * 4/1993
GB 2324717 A 11/1998

* cited by examiner

*Primary Examiner*—Sarah B McPartlin
(74) *Attorney, Agent, or Firm*—Bacon & Thomas, PLLC

(57) ABSTRACT

A collapsible highchair with a locking device includes a first frame, a second frame which is pivotally connected to the first frame in "X" shape, a seat portion pivotally connected to upper sections of the frames, a backrest connected to the upper section of the first frame, a locking device secured to top end of upper section of the second frame, and an armrest one end of which is pivotally connected to the first frame and another end is engaged with the locking device. The locking device includes a first case and a second case, both of which cover the second frame. The first case is integrally formed with an elastic actuating portion. When the actuating portion is engaged with an opening on the armrest, the highchair is in a stretched state. When the actuating portion is pressed to disengage from the opening, the highchair is in a collapsible state.

21 Claims, 10 Drawing Sheets

COLLAPSIBLE HIGHCHAIR WITH LOCKING DEVICE

FIELD OF THE INVENTION

The present invention relates generally to a highchair adapted to children, and more particularly to a collapsible highchair with a locking device.

BACKGROUND OF THE INVENTION

The highchair 400' in FIG. 1 was disclosed in U.S. Pat. No. 4,768,825. When the highchair 400' is collapsed, its front legs 11' and rear legs 12' cannot be pivotally rotated to be in a line. Also, its seat assembly 13' and backrest 14' cannot be moved to be in a line with the front legs 11' and rear legs 12'. Therefore, the volume of the collapsed highchair 400' is still large. Furthermore, the locking device used for keeping the highchair 400' in a stretched state is difficult to be operated and is unstable.

SUMMARY OF THE INVENTION

Accordingly, the present invention relates to a collapsible highchair with a locking device that is substantially intended to obviate one or more of the problems due to the limitations and disadvantages encountered in the prior art.

One object of the present invention is to provide a highchair in which the locking device is easy to be operated.

Another object of the present invention is to provide a highchair in which the locking device can stably maintain the highchair in a stretched state.

Yet another object of the present invention is to provide a highchair with a sense of valuable because it is difficult to be wavered in a stretched state.

A further object of the present invention is to provide a highchair with small volume in a collapsed state.

Additional features and advantages of the invention will be set forth in the description which follows, and in portion will be apparent from the description, or may be learned by practice of the invention. The objectives and advantages of the invention will be realized and attained by the structure as particularly set forth in the written description and claims as well as illustrated in the appended drawings.

To achieve these and other advantages and according to the purpose of the present invention, as embodied and broadly described, a collapsible highchair comprises: a first frame; a second frame pivotally connected to the first frame; a seat assembly pivotally connected to the first frame and the second frame; a backrest connected to the first frame; a locking device secured to the second frame; and an armrest pivotally connected to the first frame and disengagably engaged with the locking device; wherein when the locking device is engaged with the armrest, the highchair is in a stretched state; when the locking device is disengaged with the armrest, the highchair is in a collapsible state.

In a preferred aspect, the locking device has an actuating portion, the armrest has an opening, and the actuating portion is received within the opening.

Moreover, the locking device includes a body, an actuating portion which is partially connected to the body, and a slit which is defined between the body and the actuating portion.

It is another preferred feature that the armrest has a first wall portion, a second wall portion and two ends; the two ends are pivotally connected to the first frame; the locking device is situated between the first wall portion and the second wall portion.

Additionally, the locking device further includes a first case and a second case to enclose the second frame; the first wall portion has an opening; the first case has an actuating portion which engages with the opening.

Furthermore, the locking device further includes a first case and a second case to enclose the second frame; the armrest has two first ribs between which the locking device is received.

It is preferred that the first ribs connect the first wall portion and the second wall portion; the first ribs contact the second frame when the highchair is in the stretched state.

It is preferred that the armrest further has a second rib which extends from each the first ribs; the first ribs connect the first wall portion and the second wall portion; the second rib contacts a side face of the locking device when the highchair is in the stretched state.

It is preferred that the highchair further comprises a tray provided on the armrest.

It is preferred that the first frame and the second frame are in an "X" shape when the highchair is in a stretched state, and the first frame and the second frame are substantially in parallel when the highchair is in a collapsed state.

It is preferred that a lower section of the first frame functions as a front leg of the highchair, the backrest is connected to a upper section of the first frame, a lower section of the second frame functions as a rear leg of the highchair, and the locking device is connected to a upper section of the second frame.

It is preferred that the seat assembly is slidably connected pivotally to the first frame.

It is preferred that the upper section of the second frame is in an inverted U shape, the locking device is positioned on a top end of the upper section of the second frame, and the seat assembly is pivotally connected to side parts of the upper section of the second frame.

It is preferred that the highchair further comprises a slider slidable on the first frame and a stopper mounted on the first frame to block the slide from moving along the first frame; the seat assembly is pivotally connected to the slider.

It is preferred that the seat assembly includes a seat plate, a pivoting piece, and a pedal; the seat plate is connected to both the first frame and the second frame; the pivoting piece is pivotally connected to the seat plate; the pedal is connected to the pivoting piece and can be pivotally rotated relative to the seat plate to a collapsed position when the highchair is collapsed.

It is preferred that the seat assembly further includes an elastic piece which has a bump; the pedal has a plurality of holes; the bump is selectively received within one of the plurality of holes.

It is preferred that the highchair further comprises a link, a bracket, a slider pivotally connected to the seat assembly, and a pedal connected to the bracket; both the slider and the bracket are slidably provided on the first frame; the link connects the slider and the bracket.

It is preferred that the highchair further comprises a support member which is pivotally connected to the first frame and the pedal.

It is preferred that the highchair further comprises a stopper provided on the first frame, and the slider separably contacts the stopper.

It is preferred that the highchair further comprises a bracket which is secured to the first frame and pivotally connected to a pedal, a retainer which is secured to the pedal, and a support member which is passed through the retainer and pivotally connected to the first frame.

It is preferred that the retainer has a first slot and a second slot which is inclined to and is in communication with the first slot; the support member is selectively received in the first slot or the second slot.

It is to be understood that both the foregoing general description and the following detailed description are exemplary and explanatory and are intended to provide a further non-limiting explanation of the invention as claimed.

BRIEF DESCRIPTION OF THE DRAWINGS

The accompanying drawings, which are included to provide a further understanding of the invention and constitute a portion of the specification, illustrate embodiments of the invention and together with the description serve to explain the principle of the invention. In the drawings.

DETAILED DESCRIPTION OF THE INVENTION

Figure 1:
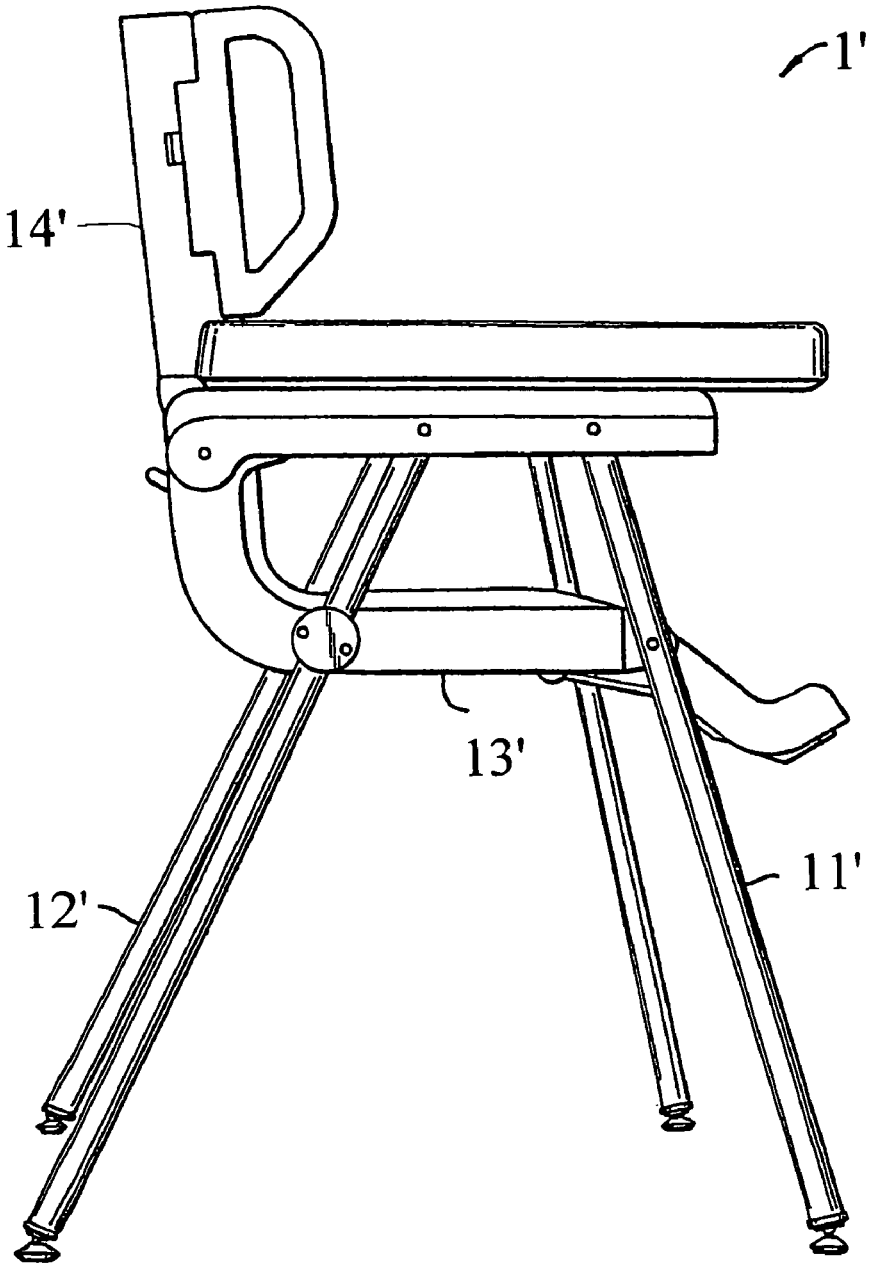
Prior Art Fig. 1
FIG. 1 is an assembled perspective view showing a conventional highchair.
Figure 2:
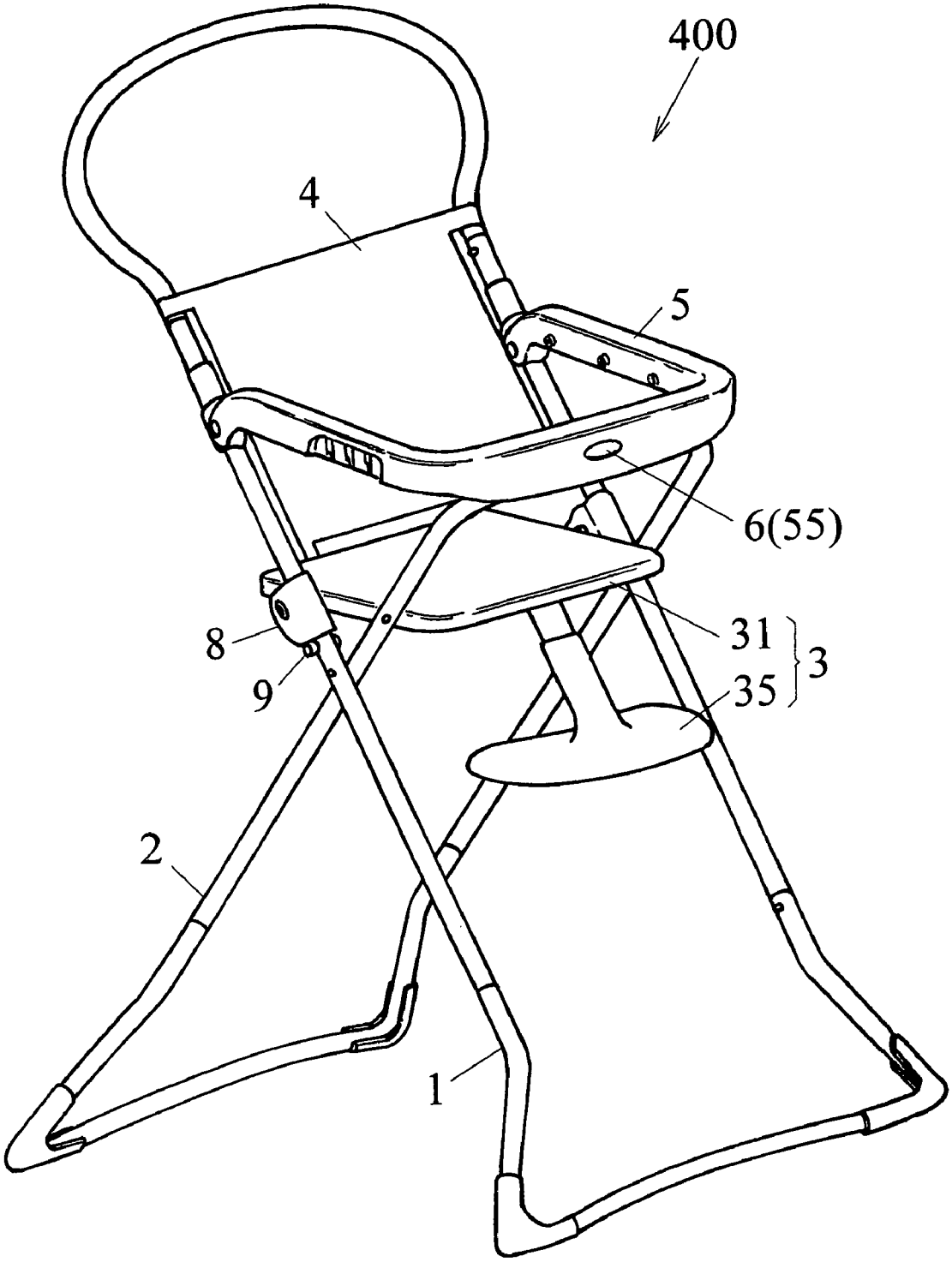
FIG. 2 is an assembled perspective view illustrating the highchair of the first preferred embodiment according to the present invention in a stretched state, in which a tray is omitted.
Figure 3:
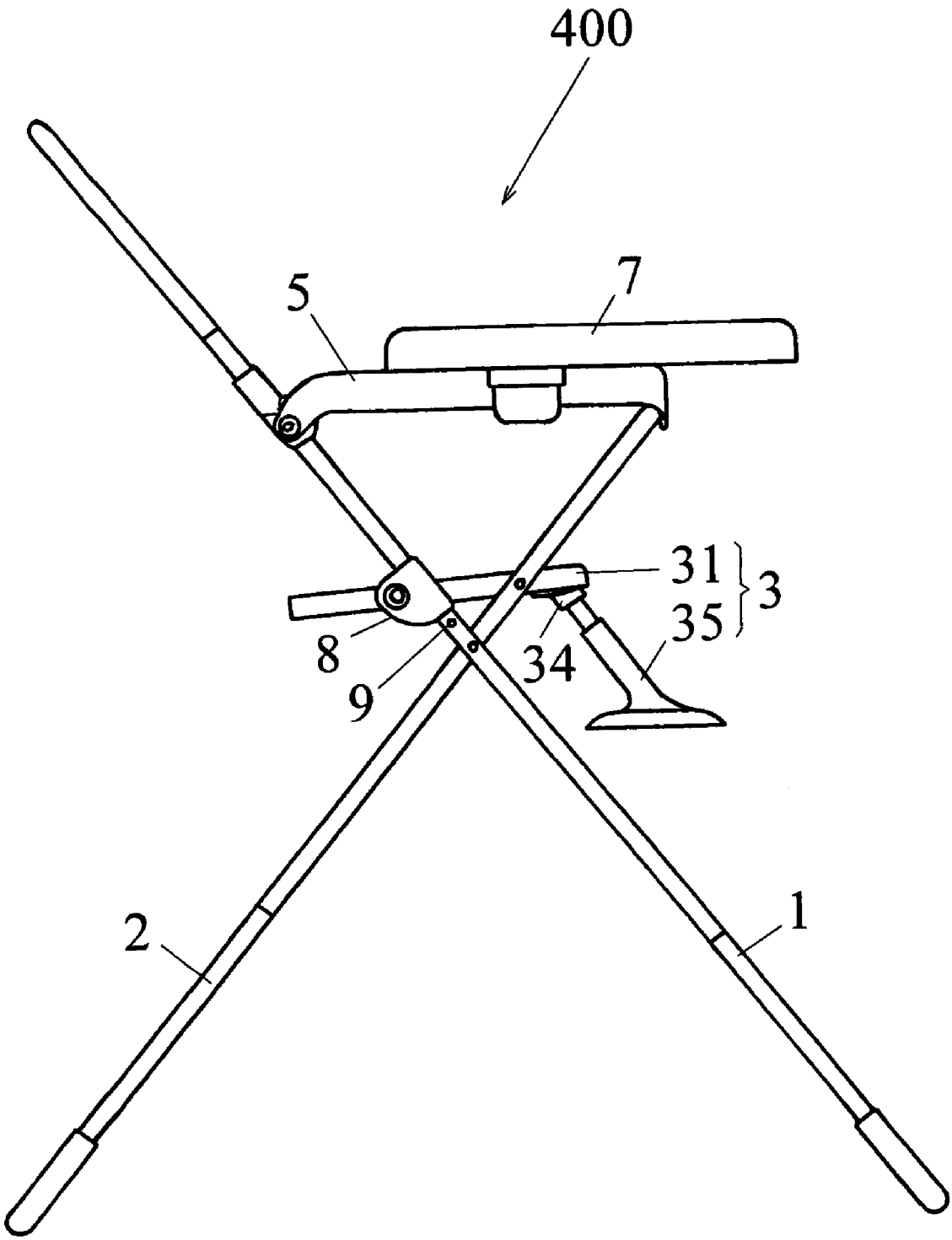
FIG. 3 is a side view according to the present invention in a stretched state, in which the tray is mounted.

Hereinafter, the "front" or "front side" is referred to the side to which the child faces when he sits in the highchair. The "back", "rear", "back side", or "rear side" is referred to the side opposite to the front side. The "upper side" or "top side" is referred to the side to which the head of the child is oriented. The "lower side" or "bottom side" is referred to the side to which the feet of the child are oriented. Besides, the rod, bar or pole may be hollow or solid As shown in FIGS. 2 and 3, the collapsible highchair 400 with a locking device of the first preferred embodiment according to the present invention comprises a first frame 1, a second frame 2, a seat assembly 3, a sheet-shaped backrest 4, a substantial U-shaped armrest 5, a locking device 6, a tray 7, a slider 8 and a stopper 9.

The first frame 1 and the second frame 2 are pivotally connected at the middle points thereof and thus formed a substantially X shape. The lower section of the first frame 1 functions as a front leg of the highchair 400 and the upper section of the first frame 1 is provided for mounting with the backrest 4. The lower section of the second frame 2 functions as a rear leg of the highchair 400. The upper section of the second frame 2 is in a shape of inverted U and the top end of the upper section of the second frame 2 is connected with the locking device 6 and supports the armrest 5.

Figure 4:
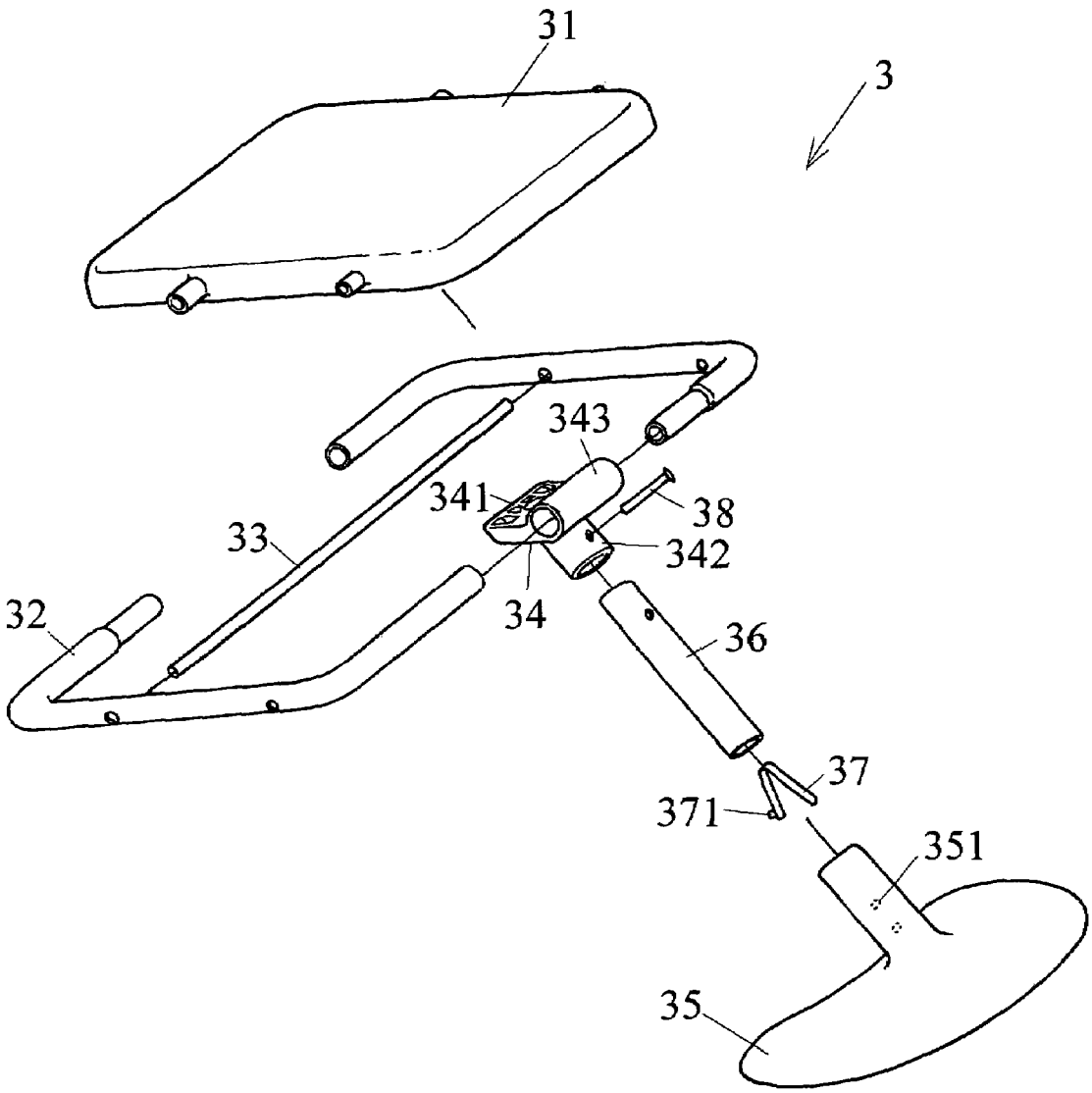
FIG. 4 is an exploded perspective view of a seat assembly included in the highchair according to the present application.

As shown in FIG. 4, the seat assembly 3 includes a seat plate 31, two U-shaped seat bars 32 mounted at the opposite edges of the seat plate 31, a pivot 33 passing through the seat bars 32, a pivoting piece 34 whose both sides pivotally connected with respectively one end of the seat bars 32, a pedal 35, an intermediate piece 36, and a V-shaped elastic piece 37. The pivoting piece 34 includes an abutting portion 341, an extending portion 342, and a pivoting portion 343 situated therebetween.

Figure 5:
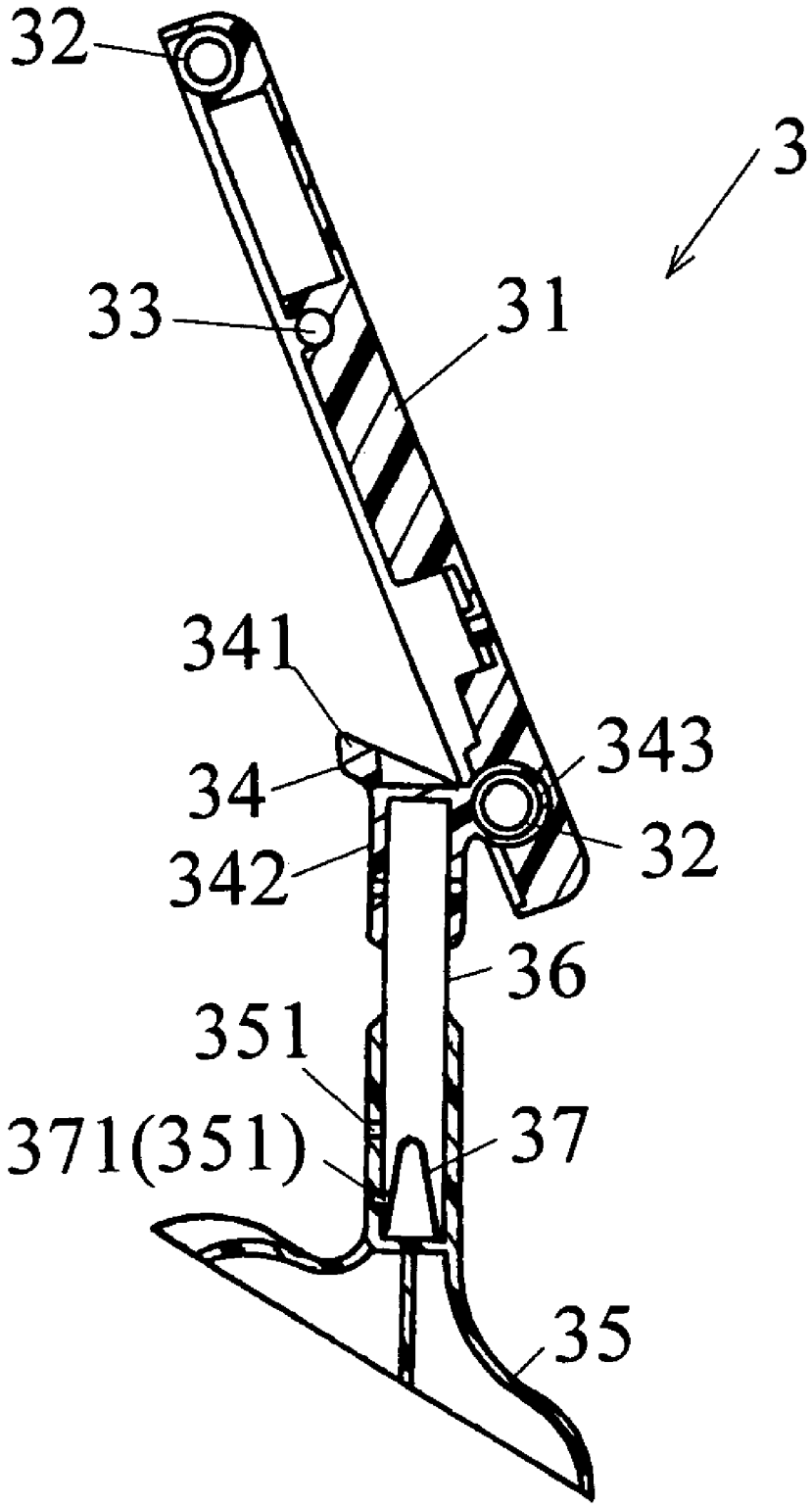
FIG. 5 is an assembled perspective view of the seat assembly in a collapsed state according to the present application.

As shown in FIGS. 4 and 5, the seat assembly 3 is completely assembled by the following processes. At first, the pivoting portion 343 of the pivoting piece 34 at two ends thereof rotatably receives one end of two seat bars 32 respectively. Next, the upper end of the intermediate piece 36 is inserted into extending portion 342 of the pivoting piece 34, and then the two members are connected together by a first fastener 38, such as a rivet. Subsequently, after the elastic piece 37 is inserted into the intermediate piece 36 from bottom end thereof, the bottom end of the intermediate piece 36 is then accommodated within the pedal 35 so that a bump 371 on one end of the elastic piece 37 passes through the intermediate piece 36 and is received within one of two holes 351 on the pedal 35. Alternatively, the seat plate 31 and seat bars 32 may be integrally formed. Besides, the intermediate piece 36 and pivoting piece 34 can be integrally formed.

The front section of the seat assembly 3 is pivotally connected to side parts of the inverted U-shaped upper section of the second frame 2. The rear section of the seat assembly 3, via two ends of the pivot 33, is pivotally connected with the sliders 8, which is sleeved on the upper section of the first frame 1. Stoppers 9, such as pins, bolts, or nuts, are secured on the upper section of the first frame 1 so as to obstruct the slider 8 from being further slid along the first frame 1. Alternatively, the slider 8 and stopper 9 can be substituted by a member with a flute. This member is secured on upper section of the first frame 1 and two ends of the pivot 33 is received and slid in the flute.

Figure 6:
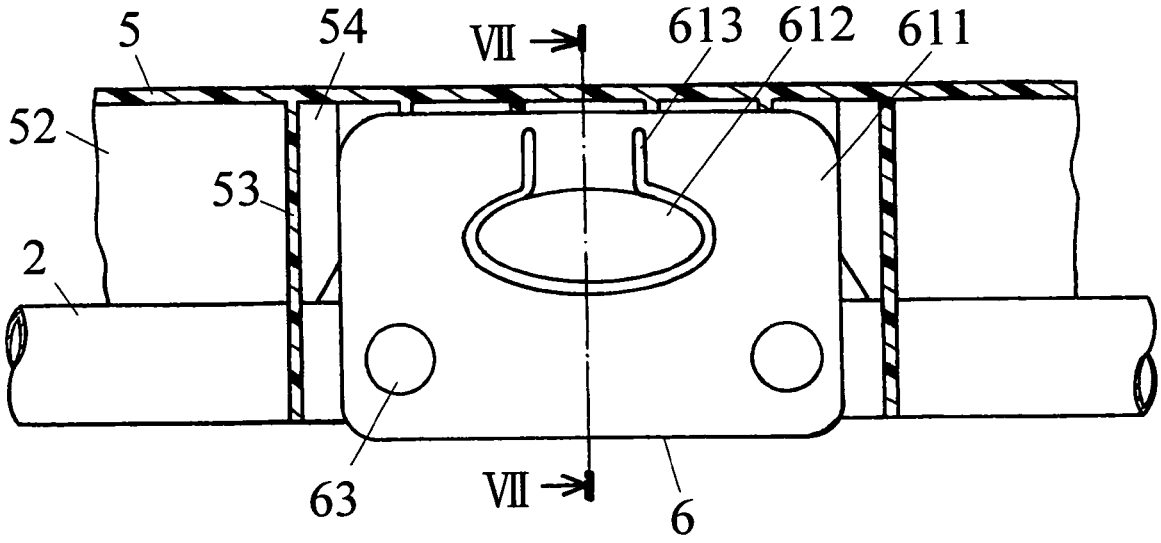
FIG. 6 is a front view taken along line VI-VI in FIG. 7 with omission of the first wall portion of the armrest, illustrating that the locking device of the highchair according to the present invention is engaged within the armrest.
Figure 7:
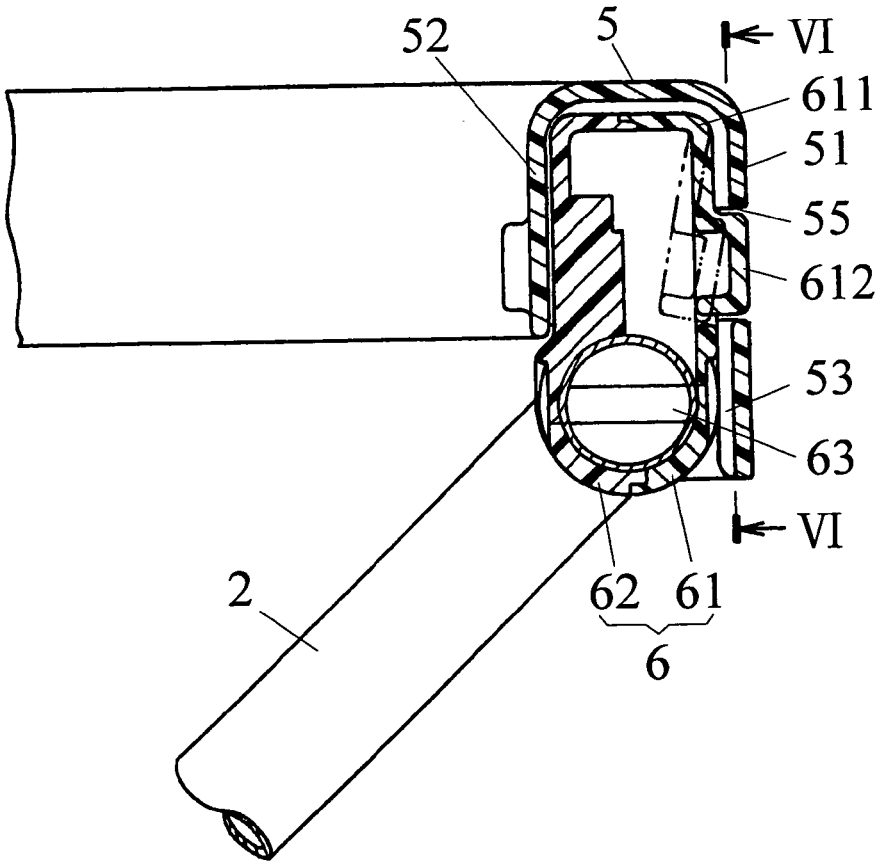
FIG. 7 is a sectional view taken along line VII-VII in FIG. 6.

As shown in FIGS. 6 and 7, the locking device 6 includes a first case 61 and a second case 62. The first case 61 may be integrally formed with a body 611 and an actuating portion 612. The actuating portion 612 is partially connected to the body 611 by a connecting part, and a slit 613 in an open-loop shape is formed between the body 611 and actuating portion 612. Therefore, the connecting part of the actuating portion 612 can be resiliently deformed when the actuating portion 612 is pressed. On the contrary, when the pressing force is disappeared, the connecting part of the actuating portion 612 is biased to restore the actuating portion 612. The top end of the second frame 2 is enclosed by the first case 61 and second case 62. A second fastener 63 is further inserted into the first case 61, second frame 2 and second case 62 so that such three members are mounted together and thus the locking device 6 is secured to the second frame 2.

Figure 8:
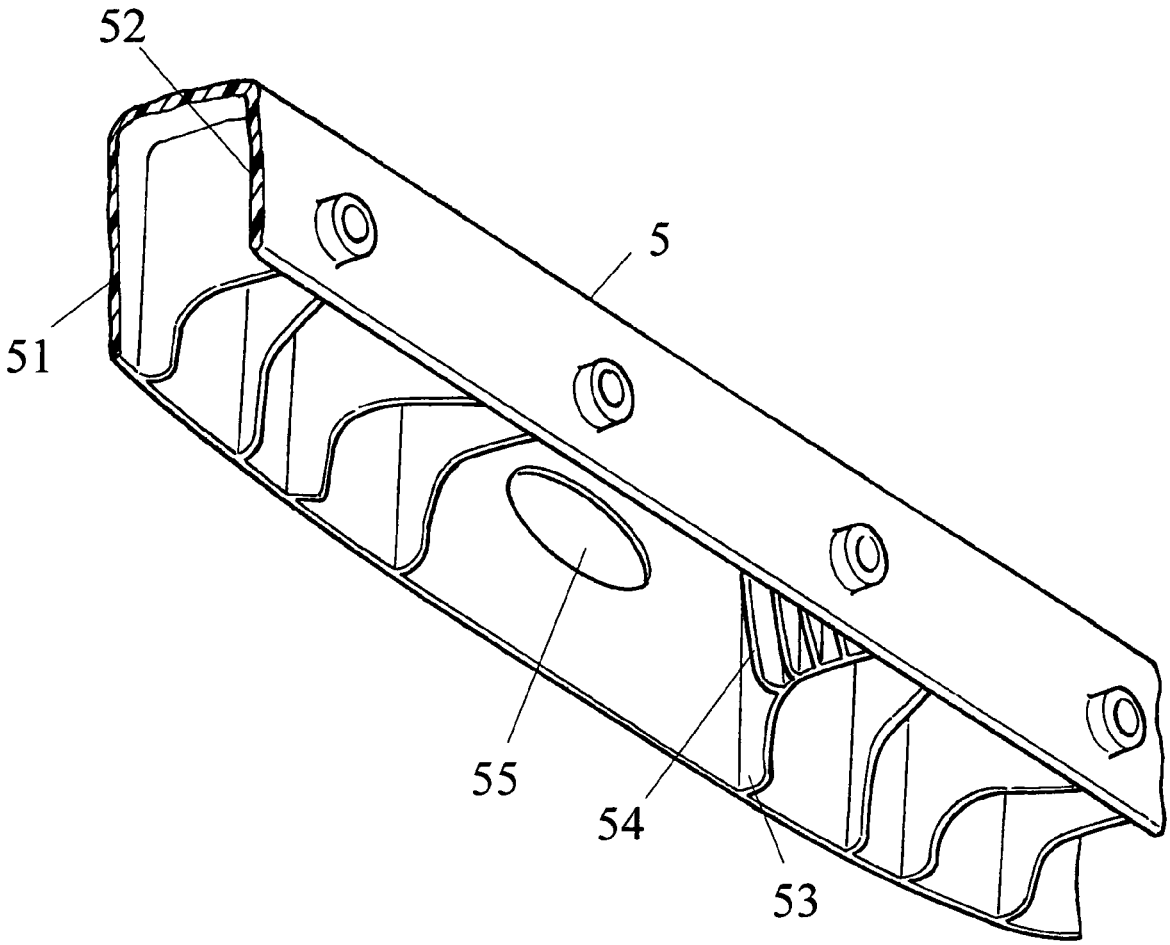
FIG. 8 is a perspective view illustrating the front portion of the armrest.

The armrest 5 at rear end thereof is pivotally connected with the first frame 1 at upper section thereof (FIG. 2). As shown in FIG. 8, the cross section of the armrest 5 at front end thereof is in an inverted U shape and includes a longer first wall portion 51 situated at front side, a shorter second wall portion 52 situated at rear side, a plurality of L-shaped first ribs 53 connecting the first and the second wall portions 51, 52, a plurality of second ribs 54 extending from two adjacent first ribs 53 at the central part of the front end of the armrest 5, and an opening 55 formed on the first wall portion 51 and between the two adjacent first ribs 53.

As shown in FIG. 3, the tray 7 is adjustably mounted on the armrest 5 in order to be adapted to different children.

Operation

As shown in FIGS. 2, 3, 6 and 7, when the highchair 400 is kept in a stretched state, the stopper 9 abuts against the bottom end of the slider 8 and the abutting portion 341 of the pivoting piece 34 abuts against the bottom face of the seat plate 32. Besides, the locking device 6 is received between two first ribs 53 at central part of the front end of the armrest 5 such that the actuating portion 612 is engaged within the opening 55 on the armrest 5 in order to prevent the armrest 5 from being separated with the second frame 2. In this state, the first ribs 53 contact front edge of the top end of the second frame 2 (FIG. 7) so as to block the armrest 5 from being wavered back and forth. Similarly, the first and the second cases 61, 62 of the locking device 6 substantially contacts the first and the second wall portions 51, 52 respectively at the central part of the front end of the armrest 5 so that the armrest 5 cannot be wavered back and forth. Furthermore, both lateral sides of the locking device 6 contact the second rib 54 (FIG. 6), in order to obstruct the armrest 5 from being wavered laterally. The highchair 400 of the first preferred embodiment according to the present invention appears valuable since it cannot be wavered and thus result in no noise.

Figure 9:
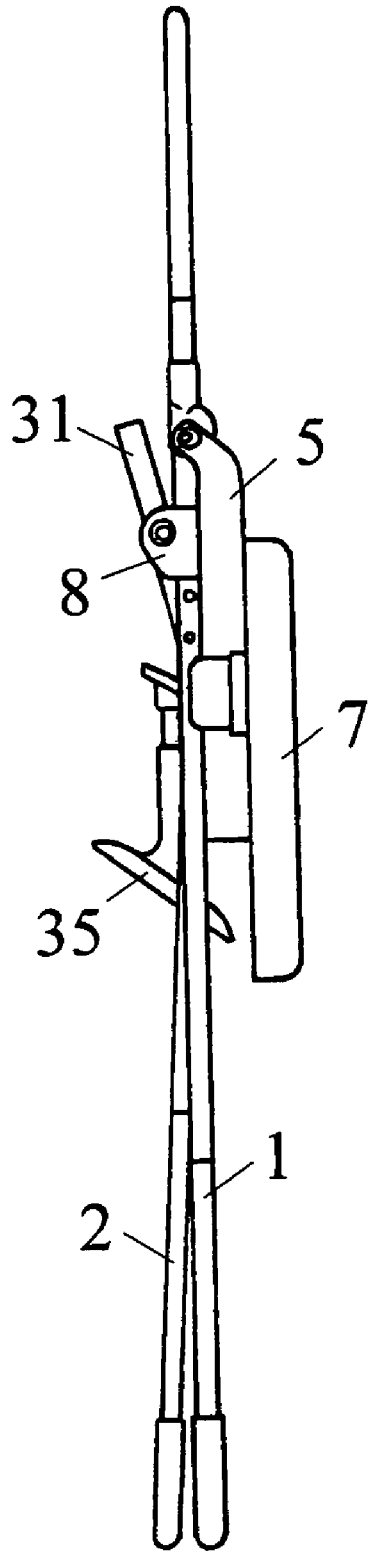
FIG. 9 is a side view of the highchair according to the present invention, illustrating the highchair is in a collapsed state.

When it is desired to collapse the highchair 400, the actuating portion 612 is first deflected to disengage from the opening 55 on the armrest 5 (as shown by broken lines in FIG. 7). Subsequently, the armrest 5 is lifted upwards so that the front end thereof is separated from the second frame 2, which allows the first frame 1 and the second frame 2 to be pivotally rotated to substantially parallel each other. Amid pivotal rotation of the first frame 1 and the second frame 2, the slider 8 is slid upwards along the first frame 1 to cooperate and rotate the seat assembly 3 to substantially parallel with the first frame 1 and the second frame 2. When the seat assembly 3 is pivotally rotated, the pivoting piece 34 is pivotally rotated relative to the seat plate 31 due to gravity of the pedal 35. Specifically, the abutting portion 341 is moved away from bottom face of the seat plate 31 (as shown in FIG. 5). Therefore, the volume of the collapsed highchair 400 is reduced. Finally, the armrest 5 along with the tray 7 can be pivotally rotated downwards to be adjacent to the first frame 1 as the collapsed state shown in FIG. 9.

When it is desired to stretch the highchair 400 again, the armrest 5 is first lifted upwards. Next, the first frame 1 and second frame 2 are pivotally rotated away from each other till the slider 8 abuts against the stopper 9. Then, the armrest 5 is pivotally rotated downwards to make the locking device 6 be received between two opposite second ribs 54 and also make the actuating portion 612 of the locking device 6 be received within the opening 55 of the armrest 5. During above operation of stretching the highchair 400, the pedal 35 will automatically rotate clockwise due to gravity of the pedal 35 and the abutting portion 341 abuts against the bottom face of the seat plate 31.

Moreover, the pedal 35 can be slid relative to the intermediate piece 36 by pressing the bump 371 of the elastic piece 37 to disengage the bump 371 from one of the holes 351 of the pedal 35. When the pedal 35 is slid, the bump 371 will snap into another hole 351 in the pedal 35. By the aid of this operation, the distance between the pedal 35 and the seat plate 31 can be adjusted to be adapted for different children.

The Second Embodiment for Collapsing the Pedal

Figure 11:
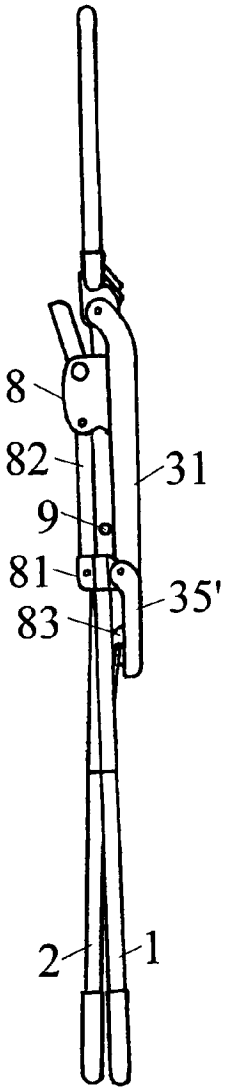
FIG. 11 is a view similar to FIG. 10 but illustrates the highchair is in a collapsed state.
Figure 10:
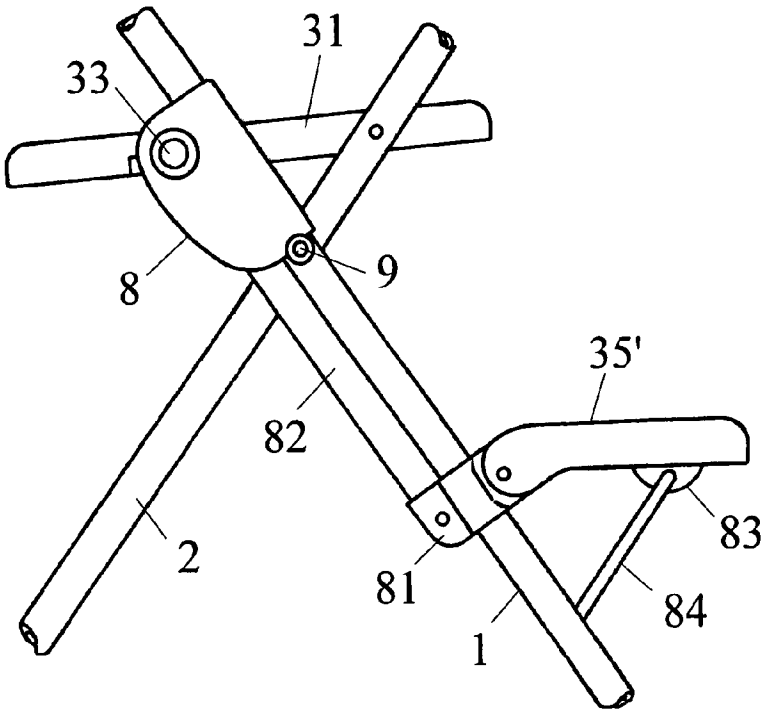
FIG. 10 is a side view of the related structures for collapsing the pedal according to the second preferred embodiment of the present invention, illustrating the highchair is in a stretched state.

The second preferred embodiment of related structures for collapsing the pedal are shown in FIGS. 10 and 11. In the second embodiment, the seat plate 31 is pivotally connected with the slider 8 by a pivot 33. Besides, two brackets 81 are sleeved on lower sections of the first frame 1 at two sides respectively. A link 82 with two opposite ends connects one side of each bracket 81 and one slider 8. Another side of each bracket 81 is pivotally connected with the pedal 35'. A retainer 83 is secured under the pedal 35' at front end. A support member 84 with two ends is pivotally connected with lower section of the first frame 1 at two sides respectively. The middle section of the support member 84 is received within the retainer 83 so that the support member 84 can be pivotally rotated relative to the retainer 83 but cannot be separated from the retainer 83.

In alternative embodiment, the retainer 83 and pedal 35' may be integrally formed.

As shown in FIG. 11, when the highchair 400 is collapsed, the slider 8 is slid upwards along the first frame 1. The link 82 and bracket 81 are cooperated and thus slid upwards to make the pedal 35' pivotally rotate relative to the support member 84. Both The pedal 35' and support member 84 be moved to adjacent to the first frame 1 as shown in FIG. 11.

The Third Embodiment for Collapsing the Pedal

Figure 12:
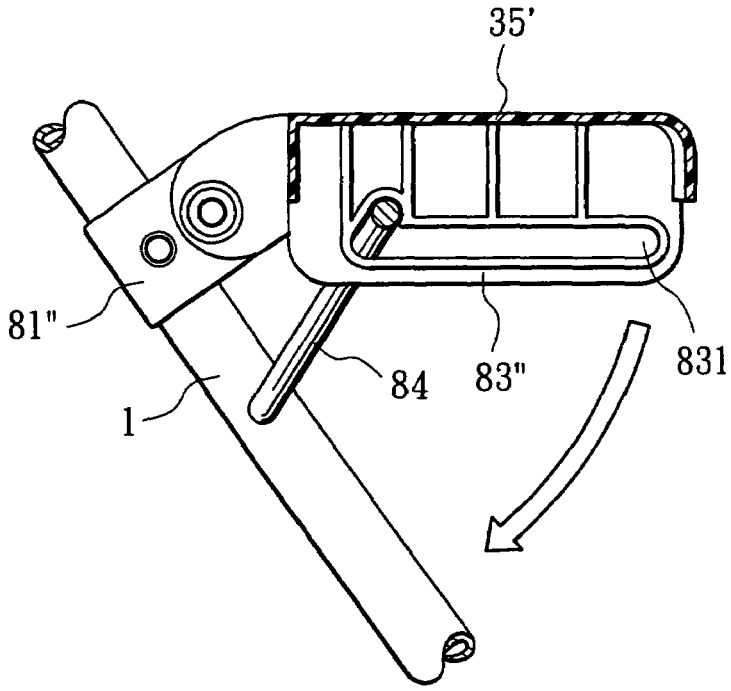
FIG. 12 is a side view of the related structures for collapsing the pedal according to the third preferred embodiment of the present invention, illustrating the highchair is in a stretched state.
Figure 13:
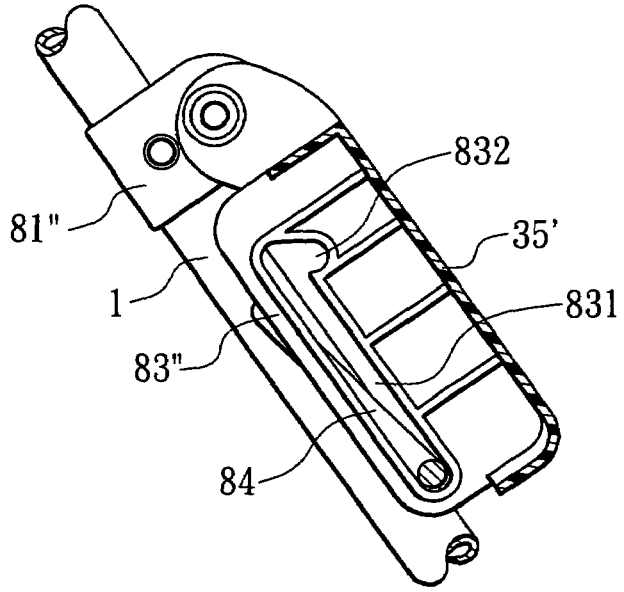
FIG. 13 is a view similar to FIG. 12 but illustrates the highchair is in a collapsed state

The third preferred embodiment of related structures for collapsing the pedal are shown in FIGS. 12 and 13. The structures in the third embodiment are similar to those in the second embodiment. However, there is no link 82 in the third embodiment. Besides, the bracket 81" in the third embodiment is secured to the first frame 1 so that it cannot be slid along the first frame 1. Furthermore, there are two sheet-shaped retainer 83" in parallel in the third embodiment. Each retainer 83" has a horizontal first slot 831 and an inclined second slot 832 which is in communication with the first slot 831.

The pedal 35' shown in FIG. 12 is in a stretched state where the support member 84 is received within the second slot 832. When it is desired to collapse the pedal 35', the pedal 35' is first lifted upwards slightly to allow the support member 84 being situated at the confluence point of the first slot 831 and the second slot 832. Then, the pedal 35' is pivotally rotated downwards to make the support member 84 be slid in the first slot 831. As the collapsed state shown in FIG. 13, the pedal 35' and the support member 84 are adjacent to the first frame 1 when the support member 84 is slid to the front end of the first slot 831.

When it is desired to stretch the pedal 35', the pedal 35' is first lift upwards to the extent that the support member 84 is slid to the confluence point of the first slot 831 and the second slot 832. Then, the pedal 35' is pivotally rotated downwards slightly to make the support member 84 be slid to the top end of the second slot 832 as stretched state shown in FIG. 12.

This invention has been disclosed in terms of specific embodiments. It will be apparent that many modifications can be made to the disclosed structures without departing from the invention. Therefore, it is the intent of the appended claims to cover all such variations and modifications that are within the breadth and scope of this invention.

What is claimed is:

1. A collapsible highchair comprising:

a first frame;

a second frame pivotally connected to the first frame;

a seat assembly pivotally connected to the first frame and the second frame;

a backrest connected to the first frame;

a locking device secured to the second frame, the locking device being integrally formed with a body and an actuating portion, the actuating portion being able to resiliently deform relative to the body; and an armrest pivotally connected to the first frame and disengagably engaged with the locking device;

wherein when the locking device is engaged with the armrest, the highchair is in a stretched state; when the locking device is disengaged with the armrest, the highchair is in a collapsible state.

2. The collapsible highchair as claimed in the claim 1, wherein the armrest has an opening, and the actuating portion is received within the opening.

3. The collapsible highchair as claimed in the claim 2, wherein the locking device includes a slit which is defined between the body and the actuating portion.

4. The collapsible highchair as claimed in the claim 1, wherein the armrest has a first wall portion, a second wall portion and two ends; the two ends are pivotally connected to the first frame; the locking device is situated between the first wall portion and the second wall portion.

5. The collapsible highchair as claimed in the claim 4, wherein the locking device further includes a first case and a second case to enclose the second frame; the first wall portion has an opening; the first case has an actuating portion which engages with the opening.

6. The collapsible highchair as claimed in the claim 4, wherein the locking device further includes a first ease and a second case to enclose the second frame; the armrest has two first ribs between which the locking device is received.

7. The collapsible highchair as claimed in the claim 6, wherein the first ribs connect the first wall portion and the second wall portion; the first ribs contact the second frame when the highchair is in the stretched state.

8. The collapsible highchair as claimed in the claim 6, wherein the armrest further has a second rib which extends from each the first ribs; the first ribs connect the first wall portion and the second wall portion; the second rib contacts a side face of the locking device when the highchair is in the stretched state.

9. The collapsible highchair as claimed in the claim 1, wherein the highchair further comprises a tray provided on the armrest.

10. The collapsible highchair as claimed in the claim 1, wherein the first frame and the second frame are in an "X" shape when the highchair is in a stretched state, and the first frame and the second frame are substantially in parallel when the highchair is in a collapsed state.

11. The collapsible highchair as claimed in the claim 10, wherein a lower section of the first frame functions as a front leg of the highchair, the backrest is connected to a upper section of the first frame, a lower section of the second frame functions as a rear leg of the highchair, and the locking device is connected to a upper section of the second frame.

12. The collapsible highchair as claimed in the claim 11, wherein the seat assembly is slidably connected pivotally to the first frame.

13. The collapsible highchair as claimed in the claim 11, wherein the upper section of the second frame is in an inverted U shape, the locking device is positioned on a top end of the upper section of the second frame, and the seat assembly is pivotally connected to side parts of the upper section of the second frame.

14. The collapsible highchair as claimed in the claim 1, wherein the highchair further comprises a slider slidable on the first frame and a stopper mounted on the first frame to block the slide from moving along the first frame; the seat assembly is pivotally connected to the slider.

15. The collapsible highchair as claimed in the claim 1, wherein the seat assembly includes a seat plate, a pivoting piece, and a pedal; the seat plate is connected to both the first frame and the second frame; the pivoting piece is pivotally connected to the seat plate; the pedal is connected to the pivoting piece and can be pivotally rotated relative to the seat plate to a collapsed position when the highchair is collapsed.

16. The collapsible highchair as claimed in the claim 15, wherein the seat assembly further includes an elastic piece which has a bump; the pedal has a plurality of holes; the bump is selectively received within one of the plurality of holes.

17. The collapsible highchair as claimed in the claim 1, wherein the highchair further comprises a link, a bracket a slider pivotally connected to the seat assembly, and a pedal connected to the bracket; both the slider and the bracket are slidably provided on the first frame; the link connects the slider and the bracket.

18. The collapsible highchair as claimed in the claim 17, wherein the highchair further comprises a support member which is pivotally connected to the first frame and the pedal.

19. The collapsible highchair as claimed in the claim 17, wherein the highchair further comprises a stopper provided on the first frame, and the slider separably contacts the stopper.

20. The collapsible highchair as claimed in the claim 1, wherein the highchair further comprises a bracket which is secured to the first frame and pivotally connected to a pedal, a retainer which is secured to the pedal, and a support member which is passed through the retainer and pivotally connected to the first frame.

21. The collapsible highchair as claimed in the claim 20, wherein the retainer has a first slot and a second slot which is inclined to and is in communication with the first slot; the support member is selectively received in the first slot or the second slot.

* * * * *